US005831529A

United States Patent [19]

Pantus

[11] Patent Number: 5,831,529

[45] Date of Patent: Nov. 3, 1998

[54] SECURITY SYSTEM IMPLEMENTED WITH AN ANTI-MASKING DECTOR USING LIGHT GUIDES

[75] Inventor: Mathias M.J. Pantus, Brunssum, Netherlands

[73] Assignee: Aritech B.V., Roermond, Netherlands

[21] Appl. No.: 887,867

[22] Filed: Jul. 3, 1997

[30] Foreign Application Priority Data

Jul. 4, 1996 [NL] Netherlands ..... 1003500

[51] Int. Cl.[6] ..... G08B 13/18

[52] U.S. Cl. ..... 340/555; 250/DIG. 1; 340/506; 340/693; 385/12

[58] Field of Search ..... 340/555, 556, 340/557, 506, 521, 693, 567, 541; 250/342, 353, DIG. 1, 227.11; 385/12

[56] References Cited

U.S. PATENT DOCUMENTS

| | | | |
|---|---|---|---|
| 3,985,454 | 10/1976 | Fletcher et al. | 356/237 |
| 4,435,093 | 3/1984 | Krause et al. | 374/129 |
| 4,709,153 | 11/1987 | Schofield | 250/353 |
| 4,710,629 | 12/1987 | Muller et al. | 250/342 |
| 4,728,794 | 3/1988 | Allen | 250/342 X |
| 4,746,910 | 5/1988 | Pfister et al. | 340/567 |
| 4,752,768 | 6/1988 | Steers et al. | 340/567 |
| 4,982,094 | 1/1991 | Matsuda | 250/342 |
| 5,091,648 | 2/1992 | Owers et al. | 340/567 X |
| 5,243,326 | 9/1993 | Disabato | 340/555 |
| 5,489,892 | 2/1996 | Imuro et al. | 340/567 |
| 5,499,016 | 3/1996 | Pantus | 340/555 |
| 5,578,828 | 11/1996 | Brown et al. | 250/342 |

FOREIGN PATENT DOCUMENTS

| | | |
|---|---|---|
| 0186226 | 11/1985 | European Pat. Off. . |
| 0189536 | 11/1985 | European Pat. Off. . |
| 0289621 | 10/1987 | European Pat. Off. . |
| 0660284 | 6/1995 | European Pat. Off. . |
| 2141228 | 6/1984 | United Kingdom . |
| 9606865 | 3/1996 | WIPO . |

OTHER PUBLICATIONS

U.S. Statutory Invention Registration H376, James Bremer, "Degradation Monitor for Laser Optics", Dec. 1987.

*Primary Examiner*—Thomas J. Mullen, Jr.
*Attorney, Agent, or Firm*—Stoel Rives LLP

[57] ABSTRACT

A surveillance system comprising a motion detector is secured by a security system comprising a light emitter and light receiver optically coupled to light guides positioned, for example, along the circumference of a light-transmitting window that covers the motion detector. In this manner the window is secured against damage or attack on its integrity, for example, in the form of a film covering or sprayed on the window. The security system delivers an alarm signal when the detected light intensity level is too low or too high.

15 Claims, 2 Drawing Sheets

SECURITY SYSTEM IMPLEMENTED WITH AN ANTI-MASKING DECTOR USING LIGHT GUIDES

TECHNICAL FIELD

The present invention relates to a security system implemented with an anti-masking detector and, in particular, to such a system in which a light emitter and light guides are optically coupled in an anti-masking detector to maintain the operational integrity of the security system.

BACKGROUND OF THE INVENTION

Security systems of this kind form part of, for example, a surveillance system that includes a motion detector for detecting the presence of objects, such as living beings, in a selected area.

EP-A-0 556 898 and its counterpart U.S. Pat. No. 5,499,016, which are assigned to the assignee of this patent application, describe a security system of the above type in which a surveillance system includes a motion detector placed behind a window that transmits electromagnetic waves. The security system is designed to protect the window from being approached, masked, or damaged. To protect the window, the security system includes a light emitter, light beam-scattering elements provided in the shape of two wings positioned outside and in front of the window, and a light receiver. The light receiver detects at least part of the light emitted by the light emitter and reflected by the wings. When an object approaches the window, there is a consequent measurable increase or decrease in the amount of light detected by the light receiver that enables production of an alarm indication.

In practice it has become apparent, however, that this security system does not in all cases adequately guarantee the integrity of the system as a whole. This is so because detection sensitivity is not equally distributed across the window and varies significantly in response to different materials used to mask the window. Moreover, a disadvantage is that, to be effective, this security system needs to operate in conjunction with a flat window.

SUMMARY OF THE INVENTION

An object of the present invention is to provide a security system that provides in a larger number of cases a greater degree of security against whatever form of attempt at sabotage or attack on the integrity of the system. To accomplish this objective, the security system according to the invention is implemented with an anti-masking detector that uses light guides.

A preferred embodiment comprises first and second spaced-apart light guides separated by a distance across and positioned in proximity to the surface of a window. The first and second light guides have opposing side surfaces positioned at the side margins and extending along the length of the window. The first light guide has an end optically coupled to a light source, and the second light guide has an end optically coupled to a light receiver. The opposing side surfaces of the first and second light guides include respective first and second light directing terminal structures. The first light directing terminal structure directs first and second sets of light rays, respectively, away from and toward the window surface. The second light directing terminal structure is positioned to receive a portion of the first set of light rays striking and reflected back by an object located near the surface to enable detection of the presence of the object. The second light directing terminal structure is positioned also to receive a portion of the second set of light rays reflected by the window surface to enable detection of an attempt to mask the surface. This embodiment can be configured to pass a relatively small number of light rays along a straight line propagation path between first and second light directing terminal structures, the absence of which light rays would indicate the existence of a technical malfunction or a situation in which the entire optical system of the anti-masking detector is blocked.

The advantage of using light-conducting elements in the security system according to the invention is that it provides against intruders a better possibility of protecting areas of more complex shapes, such as a curved window. This enhanced reliability leads to a greater flexibility as to the number and nature of possible uses. The invention also provides greater design possibilities because it is not so much governed by the technical function to be performed as is the prior art. The use of light conductive elements facilitates creation of light beams at minimal loss and shaping of the light beams so that environmental influences, such as ambient light, have a minimal influence on the operation of the security system. Thus, it is possible to configure the security system according to the invention that it will have greater public appeal and acceptance, provide a broader range of possible technical functions, and meet higher specification requirements.

The present invention and its further concomitant advantages will now be explained with reference to the accompanying drawings, in which like numerals refer to like components in the various figures of the drawings.

DETAILED DESCRIPTION OF PREFERRED EMBODIMENTS

Figure 1:
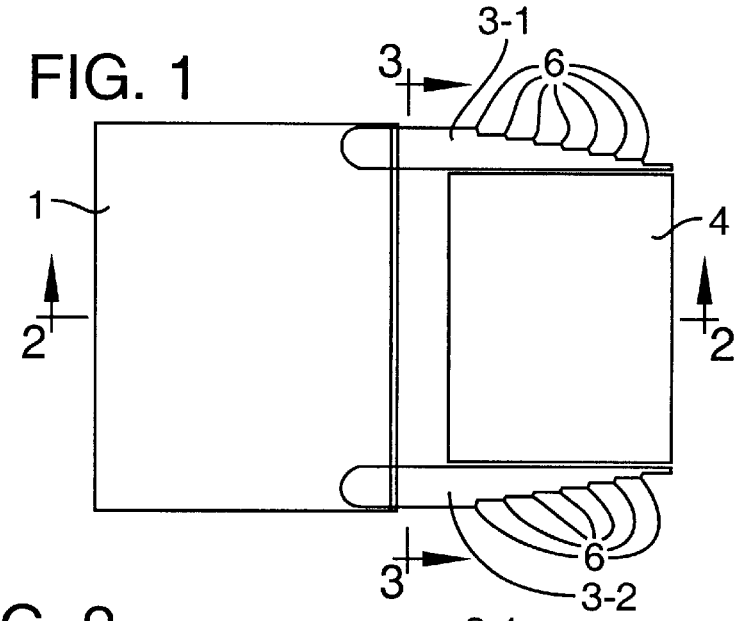
FIG. 1 is a plan view of an embodiment of the security system according to the invention.
Figure 2:
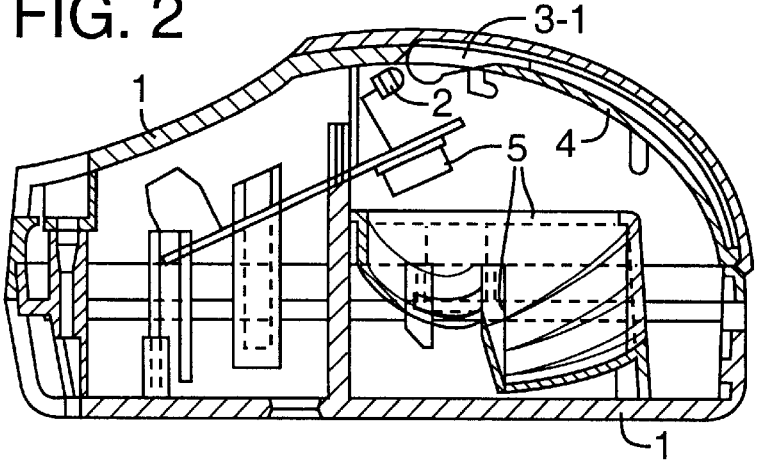
FIG. 2 is a sectional view taken along lines II—II of FIG. 1.
Figure 3:
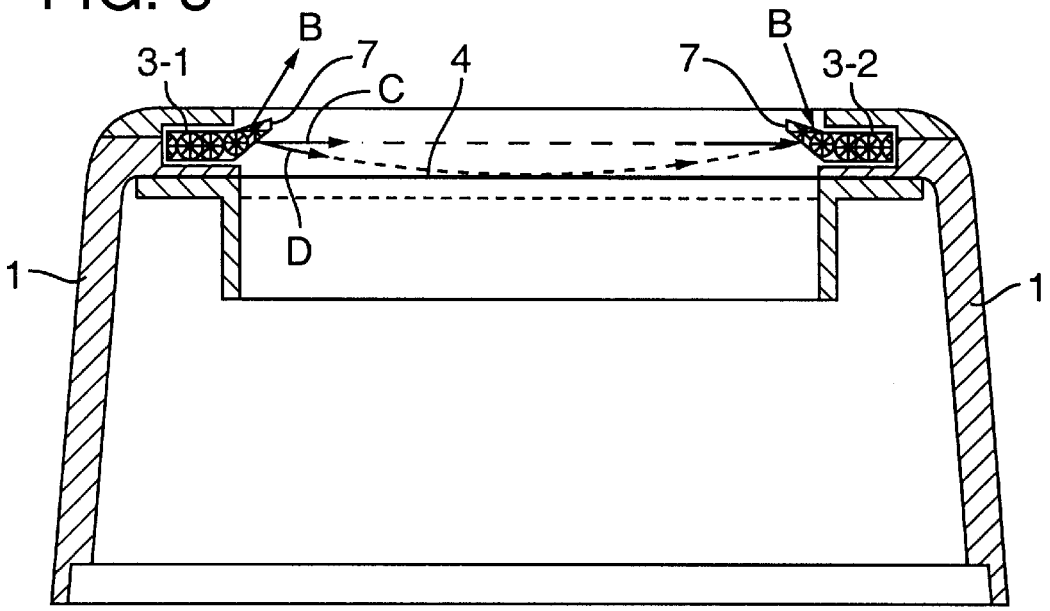
FIG. 3 is a sectional view taken along lines III—III of FIG. 1.

FIGS. 1, 2, and 3 are, respectively, a schematic plan view, a sectional view taken along lines II—II of FIG. 1 and a sectional view taken along lines III—III of FIG. 1 showing one possible embodiment of a security system in which the invention is implemented. The security system, which is accommodated in a housing 1 of a surveillance system of, for example, a room or other space, comprises a light source or emitter 2 optically coupled to a light beam-producing device implemented with light guides 3. Light emitter 2 emits electromagnetic rays in the form of visible or invisible light, for example infrared light, propagating in the direction of light guides 3. In the embodiment shown, light guides 3 are in the form of a system of light conductors 3-1 and 3-2. Light emitter 2 is optically coupled to light conductor 3-1, along which the emitted light propagates, and light conductor 3-2 is optically coupled to a light receiver 20, preferably a photodiode. Housing 1 is mirror symmetrical in the sense that lines II—II in FIG. 1 represent the axis of rotation; light emitter 2 is positioned near light conductor 3-1; and light receiver 20 is positioned near light conductor 3-2.

The specific shape of light guides 3, which is explained in more detail below, results in a light beam being built up above a light-transmitting window 4, which light beam is shaped such that in the event an attempt is made to approach window 4 with an object, a change in light intensity will be detected on the side of light receiver 20 as a consequence of the light reflecting from the object. The resulting change in light intensity received by the light receiver can be used to activate an alarm. Thus, it is possible to detect any attempt to approach, damage, or cover window 4 by means, for example, of a substance such as an opaque spray.

A motion detector 5 positioned behind light-transmitting window 4 (schematically represented in FIG. 2) is capable of detecting movements of objects as a whole, both near to and far away from the surveillance system. Motion detector 5 comprises one or more light receivers (not shown), as is known by skilled persons. Whenever an intruder enters the location where the surveillance system is installed, motion detector 5 is activated and enables generation of an alarm. Preferably, however, the security system comprising light guides 3 will remain permanently operative to detect any attempt to approach the surveillance system implemented with motion detectors, irrespective of whether their alarm outputs are being monitored.

In the illustrated embodiment, the solid angle within which motion detector 5 is capable of detecting object movement will at least partly cross a light-transmitting window 4 that is under protection by the security system. In other words, joint use is made of motion detector 5 present at window 4 and the security system protecting window 4 to provide additional security against any undesirable masking or covering of window 4. Thus, motion detector 5 is prevented from being partly or entirely blinded. This is beneficial because, if covered or masked, motion detector 5 would not be capable of detecting a movement made by an object. FIG. 3 in particular shows that light conductors 3-1 and 3-2 are positioned beside or at least partly around window 4, which is thereby fully covered by the local light beam emitted from light guides 3.

Figure 4:
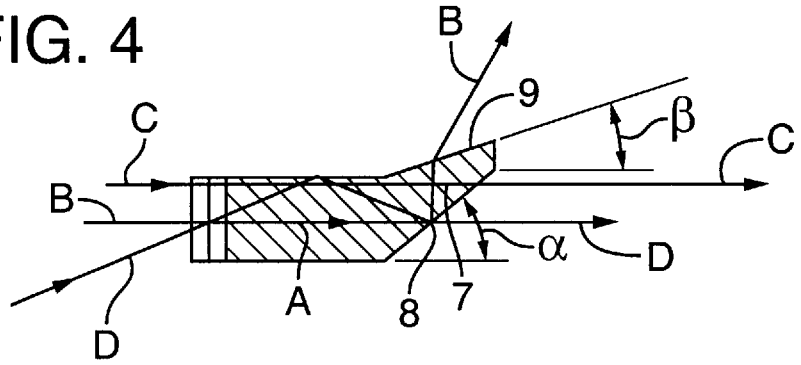
FIG. 4 shows a detail of the manner in which the light directing terminal structure shown in FIG. 3 tapers off into a point.
Figure 5:
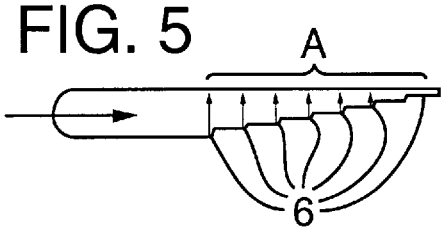
FIG. 5 shows a detail of the light directing terminal structure provided with reflectors, as shown in FIG. 1.
Figure 6:
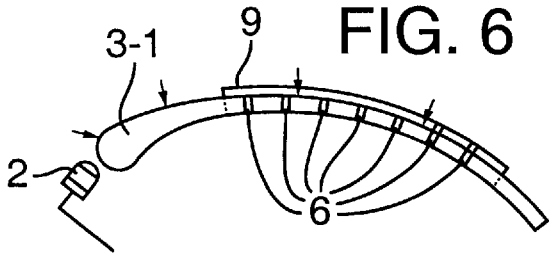
FIG. 6 is a side view of the light directing terminal structure of FIG. 5.

There are several reflection surfaces 6 provided in and along the lengths of light guides 3. In the illustrated embodiment, reflection surfaces 6 are provided in a knurled pattern of internal reflection surfaces, as is shown in detail in FIG. 5, which internally reflect the light directed into light guides 3 by light emitter 2. In FIGS. 4 and 5, the internal reflection pattern is indicated at A. In a direction towards window 4, light guides 3 include light directing terminal structures, which terminate in light output ports 7 each of which is called a "launcher" in the sense that photons are received and/or emitted in the correct amounts in various well-defined directions. A port 7 is preferably configured so as to cause refraction, a result of which a desired light beam is generated just outside window 4.

In the embodiment of light output port 7 shown in FIG. 4, an internal reflection has been obtained by means of a two-surface configuration, with a first surface 8 inclined at an angle $\alpha$, such that a first light beam B is produced after refraction by a second surface 9 inclined at an angle $\beta$. When $\alpha$ is about 39° and $\beta$ is about 15°, light beam B includes an angle of about 60° with the horizontal. As a result of the presence of the various reflection surfaces 6 along the length of a light directing terminal structure, a light beam B is generated over the entire width of window 4. In the illustrated embodiment, the specific selection of the angles $\alpha$ and $\beta$ and the irradiation of light guide 3 on the side of light emitter 2 lead to a very small portion (for example, less than 1%) of the light rays in light guides 3 crossing directly from light-conductor 3-1 to light-conductor 3-2, substantially parallel to window 4. This is the set of light rays indicated at C in FIG. 3. A set of light rays indicated at D will reflect off window 4 and then be picked up by light conductor 3-2.

Light beam B enables local protection of the surveillance system as a whole; light beam C offers security against window 4 being approached; and light beam D makes it possible to protect the outside surface of window 4 against being plastered or sprayed over. Plastering or spraying leads to a change in the surface texture characteristics and, in particular, in the degree of reflection of the upper surface of window 4. A change in reflection characteristics causes receiver 20 coupled to light conductor 3-2 to receive light below the minimum detection level and as a consequence, for example, causes an alarm to be generated. If on the other hand when an object approaches window 4 too closely, a maximum received intensity level is exceeded, and an alarm is likewise generated.

Figure 7:
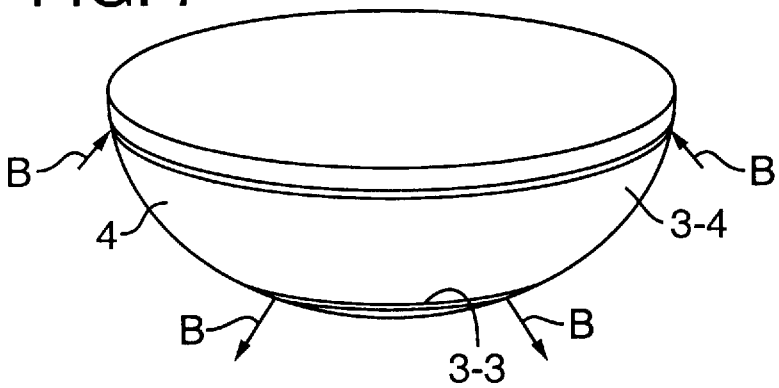
FIG. 7 shows an alternative embodiment of the security system in which the invention is mounted on a room ceiling.

FIG. 7 shows an alternative embodiment of the security system according to the invention. This security system, which is suitable for mounting on, for example, a wall or a ceiling and which is capable of omnidirectional detection, if desired, is built up of circular light-conductors 3-3 and 3-4, between which window 4 is positioned. In contrast to a situation in which window 4 of the preceding embodiment is curved in one direction and is yet fully secured, window 4 of the alternative embodiment shown in FIG. 7 is curved in two directions. Light beams C and D can be omitted by adapting the shape of port 7, if desired, so that the respective surfaces will develop the local formation of only light beam B. Window 4, behind which motion detector 5 is present, is secured similarly as described before for the embodiment of FIG. 1.

Light beam B actually consists of an active beam from light emitter 2, which is emitted by light conductors 3-1 (FIG. 3) and 3-3 (FIG. 7), while on the other hand a light sensitivity beam concentrates near light conductors 3-2 and 3-4. This light sensitivity beam actually marks the sensitivity to light directed from a particular direction.

Figure 8:
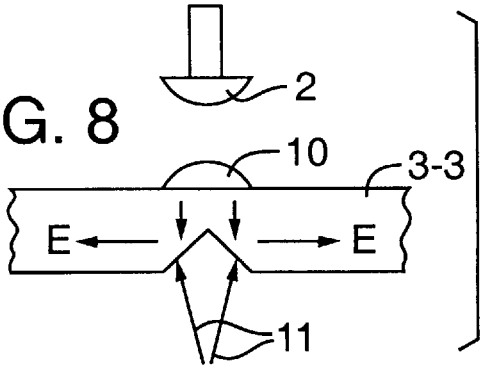
FIG. 8 is a schematic representation of the manner in which an air prism is used in the embodiment of FIG. 7.

FIG. 8 shows a specific manner in which light emitter 2 provides light to light conductor 3-3. Optical emitter 2 beams light onto a lens 10, which is provided on light conductor 3-3. An air prism 11 formed by providing two sloping surfaces at the bottom side causes a light beam E to propagate concentrically to the outside surface of light conductor 3-3 when the positions of the surfaces and the lens 10 are suitably selected, thus forming the exiting beam B previously explained above.

Light guides 3 are preferably made of polycarbonate, PMMA (polymethyl methacrylate), PET (polyethylene teraphthalate), or PVC (polyvinyl chloride). Each of these materials is relatively easy to process and exhibits low light-absorption, which leads to a high light output at a given power output from light emitter 2.

Of course, variations to the shape of light guides 3 themselves and the shapes of the various light beams formed are possible within the framework presented herein. Moreover, mirror surfaces, refraction surfaces, or refraction index profiles may be added to or be combined with light guides 3 to transport the light internally and form the desired light beam.

It will be obvious to those having skill in the art that many changes may be made to the details of the above-described embodiments of this invention without departing from the underlying principles thereof. The scope of the present invention should, therefore, be determined only by the following claims.

I claim:

1. A security system having an anti-masking detector using light guides, comprising:

first and second spaced-apart light guides having first and second opposing side surfaces separated by a distance across and positioned in proximity to a light-transmitting surface, the first light guide having an end optically coupled to a light source and the first side surface including a first light directing terminal structure, and the second light guide having an end optically coupled to a light receiver and the second side surface including a second light directing terminal structure, the first light directing terminal structure receiving light emitted by the light source to form and direct first and second sets of light rays in predetermined directions, respectively, away from and toward the light-transmitting surface, and the second light directing terminal structure positioned to receive a portion of the first set of light rays striking and reflected back by an object located near the light-transmitting surface to enable detection of the presence of the object and positioned to receive a portion of the second set of light rays reflected by the light-transmitting surface to enable detection of an attempt to mask it.

2. The security system of claim 1, further comprising a motion detector that is capable of detecting object movement within a solid angle, the first and second sets of light rays at least partly crossing the solid angle.

3. The security system of claim 2 in which the light-transmitting surface has side margins, the motion detector is placed behind the light-transmitting surface, and the first and second light guides are at least partly positioned beside the side margins of the light-transmitting surface.

4. The security system of claim 3 in which the first and second light guides are at least partly positioned around the light-transmitting surface.

5. The security system of claim 3 in which the first and second light guides are at least partly positioned in front of the light-transmitting surface.

6. The security system of claim 1 in which the light-transmitting surface has a curved configuration and in which the first and second light guides are curved to be capable of securing the light-transmitting surface having a curved configuration.

7. The security system of claim 1 in which the first and second light guides are in the shape of the light-transmitting surface.

8. The security system of claim 1 in which the first and second light guides are mirror images of each other.

9. The security system of claim 1 in which each of the first and second light directing terminal structures forms at least one substantially forward light beam.

10. The security system of claim 9 in which each of the first and second light directing terminal structures is shaped to form continuously refracted first and second sets of light rays directed in the predetermined directions, the continuously refracted light rays in the first and second sets being formed by either single or multiple refractions.

11. The security system of claim 9 in which each of the first and second light directing terminal structures includes abutting surfaces that form one or more internal reflection surfaces inclined at certain angles.

12. The security system of claim 1 in which the first and second light directing terminal structures include reflectors.

13. The security system of claim 12 in which the first and second light guides have interiors and in which the reflectors comprise a series of reflection surfaces provided one behind the other in the interiors of the first and second light guides.

14. The security system of claim 1 in which the first and second light guides are made of the polycarbonate, PMMA (polymethyl methacrylate), PET (polyethylene teraphthalate), or PVC (polyvinyl chloride).

15. The security system of claim 1 in which each of the first and second light guides comprises an air prism.

* * * * *